United States Patent [19]

Ravera

[11] 4,133,270

[45] Jan. 9, 1979

[54] PLATFORM FOR THE LIFTING AND HANDLING OF GOODS

[75] Inventor: Pasquale Ravera, Turin, Italy

[73] Assignee: Stars Stampaggio Resine Speciali S.p.A., Turin, Italy

[21] Appl. No.: 815,686

[22] Filed: Jul. 5, 1977

[30] Foreign Application Priority Data

Jul. 6, 1976 [IT] Italy ..... 68680 A/76

[51] Int. Cl.[2] ..... B65D 19/32

[52] U.S. Cl. ..... 108/51.1; 108/901

[58] Field of Search ..... 108/51.1, 56.1, 57.1, 108/901, 902, 53.3, 55.1, 56.1, 53.1; 206/386

[56] References Cited

U.S. PATENT DOCUMENTS

| | | | |
|---|---|---|---|
| 3,603,272 | 9/1971 | Ditges | 108/901 X |
| 3,667,403 | 6/1972 | Angelbeck, Jr. | 108/901 X |
| 3,699,902 | 10/1972 | Allgyer et al. | 108/901 X |
| 3,759,194 | 9/1973 | Fujii et al. | 108/901 X |
| 3,835,792 | 9/1974 | Wharton | 108/902 X |
| 3,868,915 | 3/1975 | Hafner | 108/901 X |
| 3,964,400 | 6/1976 | Brand | 108/51.1 |

*Primary Examiner*—Roy D. Frazier
*Assistant Examiner*—William E. Lyddane
*Attorney, Agent, or Firm*—Scully, Scott, Murphy & Presser

[57] ABSTRACT

A platform for the lifting and handling of goods comprising a base frame, a loading frame, both made of a polymeric material, and superimposed on one another, and uprights extending between and connecting the frames. The loading frame is formed by a pair of reticular structures, which are superimposed on one another. The intersecting elongate members of each reticular structure are staggered with respect to those in the other such structure and the reticular structures are connected to form a rigid construction at least by means of joining elements connecting the structures at locations where the elongate members of one structure cross those of the other structure.

6 Claims, 7 Drawing Figures

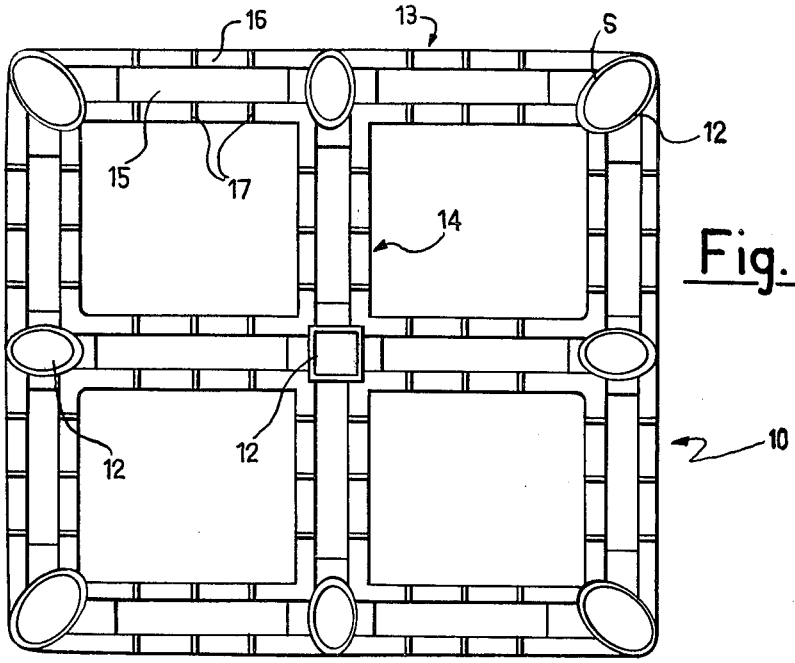
Fig. 1
Fig. 2
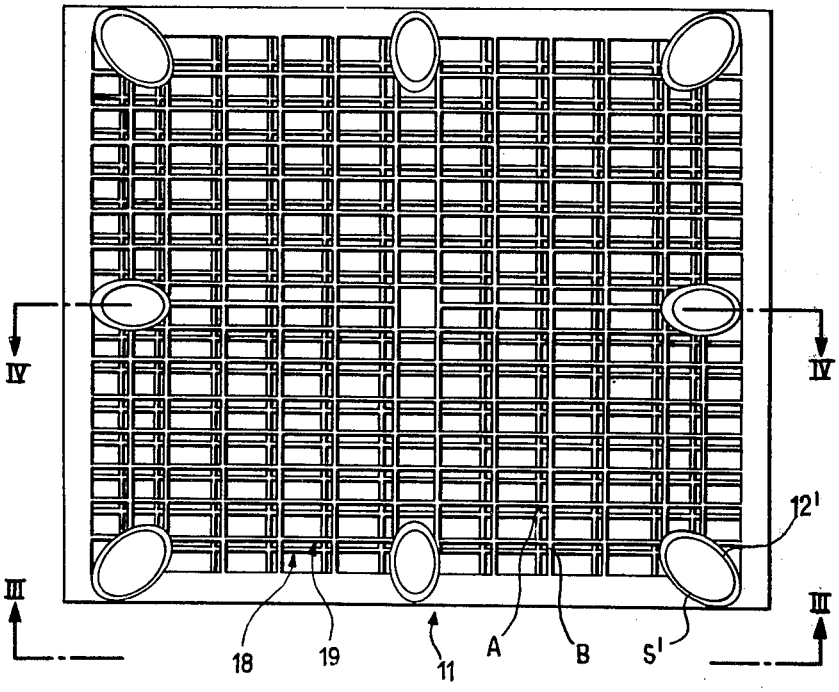

PLATFORM FOR THE LIFTING AND HANDLING OF GOODS

FIELD OF THE INVENTION

The present invention relates to a platform, commonly called "pallet", for the lifting and handling of goods, particularly by means of fork lift trucks.

BACKGROUND TO THE INVENTION

Platforms of the specified type made entirely of a polymeric material are known. They present considerable advantages with respect to prior conventional platforms made of wood and/or metal, particularly by achieving an important weight reduction. However, due to the low value of the modulus of elasticity of the material used, it is necessary, in order to obtain a suitable stiffness of the platform, to give it such a shape as to make it sufficiently rigid.

The constructions proposed so far have not given fully satisfying results especially for overcoming the difficulty of obtaining by moulding, rationally outlined sections, that is, sections which have sufficient stiffness against flexure using the minimum quantity of material.

The essential object of present invention is to obviate such a drawback by providing a platform having considerable stiffness but still easily formed by standard moulding methods for the forming of polymeric material, particularly methods using co-operating mould halves, without causing any difficulty in removal from the mould and without requiring complicately outlined and structured moulds.

Another object of the invention is to provide a platform suitable for the lifting and handling of goods of any kind and particularly goods causing locally concentrated loads and pulverulent material contained in sacks.

SUMMARY OF THE INVENTION

According to the invention, said objects and others which will result from the following specification are attained by providing a platform for the lifting and handling of goods, comprising a base frame, a frame forming a loading plane, both frames being made of a polymeric material, and being superimposed on one another, and uprights extending between and connecting the frames, the frame forming the loading plane, being formed by a pair of superimposed reticular structures which each comprise a network of intersecting elongate members, the members of each reticular structure being staggered with respect to those in the other such structure and the reticular structures being connected to form a rigid construction at least by means of joining elements connecting the structures at locations where the elongate members of one structure cross those of the other structure.

BRIEF DESCRIPTION OF THE DRAWINGS

FIG. 1 is a top plan view of the base frame of one embodiment of the invention;

FIG. 2 is a bottom plan view of the frame forming the loading plane;

Referring to FIGS. 1 to 6, reference numeral 10 indicates the base frame and 11, the frame forming the loading plane.

Both frames are made of a polymeric material, e.g. a thermoplastic material, and are formed separately by moulding and are subsequently superimposed with juxtaposed end faces S, S' of corresponding upright sections 12, 12' provided around the periphery of both said frames secured to each other by any suitable known method, e.g. by welding or by the use of adhesive material.

Figure 3:
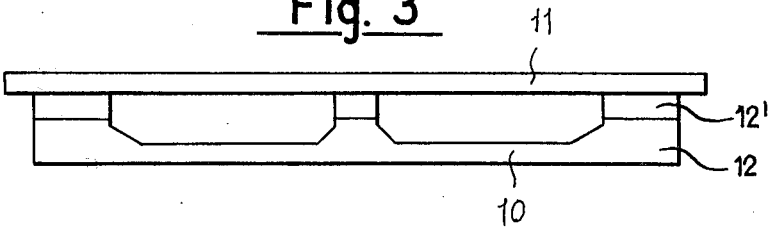
FIG. 3 is a side elevation view in the direction of arrows III—III of FIG. 2.
Figure 4:
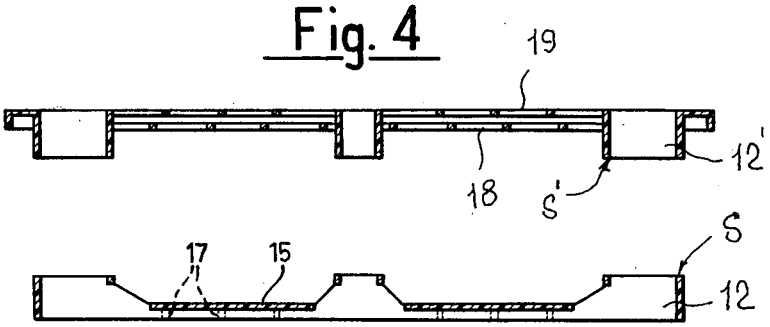
FIG. 4 is an exploded section along line IV—IV of FIG. 2.

The platform formed of such two superimposed structures, as clearly shown on FIGS. 3 and 4, provides a light construction which is highly resistant to bending stresses.

A greater increase of such resistance to bending stresses and stresses deriving from locally concentrated loads and similar loads, is obtained, in constructions according to the invention, by designing the base frame and the loading frames 10 and 11 so as to increase correspondingly the moment of inertia of the resistant section in relation to the types of stress acting on said frames.

Considering conditions of combined compressive and bending stresses due to the load, the base frame 10 will be subjected to tensile stress and the loading frame 11 to compressive stress.

Thus, in the illustrated embodiment of the invention, the base frame 10 has a structure comprising a perimetrical rim 13 and a cruciform stiffening structure 14. Both said structures comprise a raised central portion 15 provided on both sides with side walls 16, the portion 15 and side walls 16 being connected by transversal stiffening ribs 17.

The frame 11, due to the required increase of the resistance to the compressive stresses and reduction of the weight, is formed by a pair of superimposed reticular structures 18, 19, having advantageously a network of elongate members of rectangular cross-sections having dimensions of about 8 × 10 cm.

As clearly shown in the Figures when observed in a plan view, the elongate members of the superimposed structures are staggered by being mutual displaced in two orthogonal directions so that such elongate members cross at zones A and B. At those zones, the two reticular structures 18, 19 are rigidly connected by means of joining elements in form of uprights 20, **20*a*** having cross-sectional dimensions corresponding to the breadth of joists T, T' which make up the elongate members of the structure to lie flush with the side surfaces of said joists, to allow the removal of the frame from the mould halves after its moulding therein.

Figure 7:
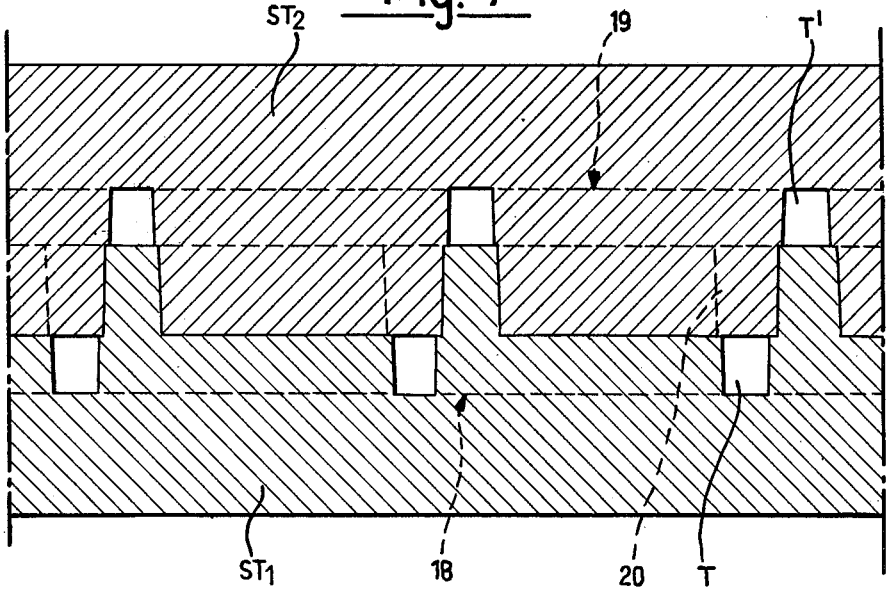
FIG. 7 is a section of a mould showing the outline of the mould halves and the use of such parts in the moulding of said superimposed reticular structures.
Figure 5:
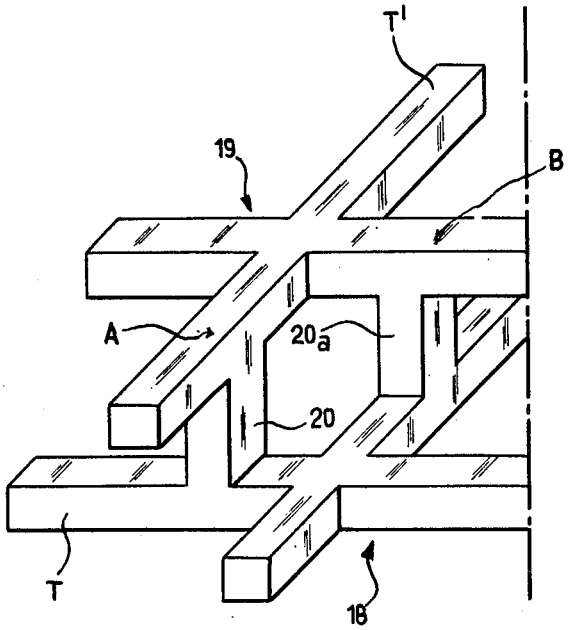
FIG. 5 is a perspective view illustrating the superimposed reticular structures.

In FIG. 7, it will be seen that the mould is of the type comprising two mould halves $ST_1$ - $ST_2$ which penetrate one another, the mould $ST_1$ being formed with cavities having the profiles of the lower joists T which are so shaped to permit subsequent removal from the mould $ST_1$, mould $ST_2$ being formed with cavities having the profiles of the upper joists T' which are so shaped to permit removal from the mould $ST_2$. In the closed position of the mould such cavities are spaced apart by a distance equal to the vertical extension of uprights 20.

Figure 6:
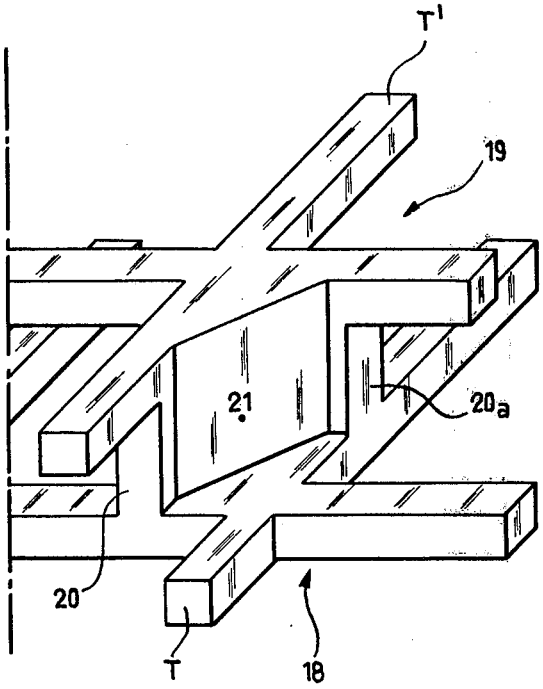
FIG. 6 is a perspective view similar to that of FIG. 5 illustrating the reticular structures according to another embodiment of the invention.

FIG. 6 shows another embodiment in which a different type of connection of the reticular structures at the aforesaid zones is used. In this embodiment, the adjacent uprights, 20, 20*a* are connected by a solid web 21 which closes the space in the loading frame defined between those uprights, thereby further stiffening the structure with respect to bending stresses and stresses tending to displace the reticular structures relative to each other in the parallel planes containing such elements. It will be appreciated that the web 21, which provides a continuation of the uprights and extends parallel to their vertical direction, does not cause any problem relating to removal of the upper frame 11 from the mould in which it is formed so that in this embodiment as well the structures 18, 19, 20, 21 can be formed by using a two-part mould having mould halves such as $ST_1$ and $ST_2$.

From the above, it will be evident that the assembly structure of a loading platform or "pallet" according to the present invention, while allowing a considerable reduction of material and therefore a reduction of the weight, also assures, due to the rationalization of the resistant element profiles, the required stiffness and the necessary resistance to stresses deriving from loads applied to the platform.

It will also be appreciated that the construction of the superimposed reticular structures 18, 19 although forming a discontinuous loading plane, allows the transport of pulverulent material packed in sacks avoiding difficulties which occur with some prior constructions, e.g. designs having loading planes formed only of intervaled strips wherein portions of the sacks get entangled between said strips and torn during unloading.

What is claimed is:

1. In a platform for the lifting and handling of goods, comprising a base frame, a frame forming a loading plane, both frames being made of a polymeric material, and being superimposed on one another, and uprights extending between and connecting the frames, the improvement wherein the frame forming the loading plane is formed by a pair of spaced apart superimposed reticular structures which each comprise a network of intersecting elongate members, the members of each reticular structure being staggered with respect to those in the other such structure and the reticular structures being connected at least by means of joining elements connecting the structures at locations where the elongate members of one structure cross those of the other structure forming the loading frame itself as a rigidly braced three dimensional reticular framework structure.

2. A platform according to claim 1 wherein the said reticular structures are formed by series of joists located to form said elongate members having the cross-sectional dimensions of about 8 × 10 cm.

3. A platform according to claim 1 wherein said joining members are uprights having cross-sectional dimensions corresponding to the breadth of the respective elongate members which they connect so as to lie flush with the side surfaces of the elongate members in order to allow removal of the frame from the mould after its forming therein.

4. A platform according to claim 1 wherein a web connects adjacent joining elements and closes the space in the superimposed structures, when viewed from above, defined between those joining elements.

5. A platform according to claim 1 wherein the base frame is formed by a structure comprising a perimetrical rim and a cruciform central stiffening structure both formed of elements comprising a raised central portion having on both sides side walls; said portions and side walls being connected by transversel stiffening ribs.

6. A platform according to claim 1 wherein the base frame and the frame forming the loading plane are separate mouldings and said uprights comprise upright sections formed around the periphery of the opposed faces of said frames which sections have juxtaposed end surfaces secured together.

* * * * *